US010856676B2

(12) United States Patent
Bentzur

(10) Patent No.: US 10,856,676 B2
(45) Date of Patent: Dec. 8, 2020

(54) DISPOSABLE VASE

(71) Applicant: Yoram Bentzur, Kohav Yair (IL)

(72) Inventor: Yoram Bentzur, Kohav Yair (IL)

( * ) Notice: Subject to any disclaimer, the term of this patent is extended or adjusted under 35 U.S.C. 154(b) by 258 days.

(21) Appl. No.: 15/519,550

(22) PCT Filed: Jul. 29, 2015

(86) PCT No.: PCT/IL2015/050781
§ 371 (c)(1),
(2) Date: Apr. 16, 2017

(87) PCT Pub. No.: WO2016/067277
PCT Pub. Date: May 6, 2016

(65) Prior Publication Data

US 2017/0231406 A1 Aug. 17, 2017

(30) Foreign Application Priority Data

Oct. 26, 2014 (IL) ..... 235340

(51) Int. Cl.
*A47G 7/06* (2006.01)

(52) U.S. Cl.
CPC ..... *A47G 7/06* (2013.01); *A47G 7/063* (2013.01)

(58) Field of Classification Search
CPC ..... A47G 7/06; A47G 7/063; B65D 33/01
USPC ..... 206/423
See application file for complete search history.

(56) References Cited

U.S. PATENT DOCUMENTS

| | | | | |
|---|---|---|---|---|
| 3,753,314 A * | 8/1973 | Clark | A01G 9/02 215/400 |
| 6,381,901 B1 * | 5/2002 | Friedman | A01G 9/028 206/752 |
| 6,672,002 B1 | 1/2004 | Gumpper | |
| 2004/0083649 A1 | 5/2004 | Weder | |
| 2005/0210741 A1 | 9/2005 | Feddern | |
| 2011/0099896 A1 | 5/2011 | Weder | |

FOREIGN PATENT DOCUMENTS

| | | | |
|---|---|---|---|
| DE | 1877613 U | 8/1963 | |
| DE | 29507851 U1 | 9/1995 | |
| DE | 10 2008 024347 A1 | 12/2009 | |
| GB | 2361000 A * | 10/2001 | A47G 7/063 |

* cited by examiner

*Primary Examiner* — Anthony D Stashick
*Assistant Examiner* — James M Van Buskirk
(74) *Attorney, Agent, or Firm* — Mark David Torche; Patwrite Law

(57) ABSTRACT

A vase including sidewalls; an open upper end; a vase bottom; and at least one water-receiving compartment. The water receiving compartment is substantially located proximal to the vase bottom, configured to hold water, and includes at least one flower support base including at least one aperture which is spaced apart from the vase bottom. The at least one aperture is configured to allow water to pass there-through and configured or disposed to prevent stems of the flowers to pass through. As a result, when in use, flowers in the vase are prevented from consuming the water in the compartment, while water held in the receiving compartment provides weight to stabilize the vase.

12 Claims, 6 Drawing Sheets

DISPOSABLE VASE

FIELD OF THE INVENTION

The present invention relates to floral containers, in particular vases.

BACKGROUND OF THE INVENTION

Cut flowers are commonly displayed in vases. Such vases are typically made of glass or ceramic material and thus may be heavy, fragile and not easy to clean. Also there may be an unpleasant odor in the vase from the flowers standing in the water for a long time and/or from bacteria developing in the water.

Flowers drink a lot of water. It is not uncommon for a large flower arrangement to suck up all the water in a vase within the first few days. Flowers are also highly susceptible to bacteria that build up as stems sit in the water. Bacteria build up in dirty vases and remain even after the vase dries out. As soon as water is added again, the vase will again be full of bacteria and the new bouquet will be subjected to the same bacteria that helped kill the previous bouquet. With a fresh clean environment free of bacteria, flowers last longer.

It is believed that the following publications represent the current state of the art:

US2011099896 (Donald Weder) "Floral container and methods of use thereof", publication date: 5 May 2011; US2005/210,741 (Troy Feddern) "Disposable paper vase", publication date: 29 Sep. 2005; CN202234308U (Shenngnan Ni) "Simple flower vase", publication date: 30 May 2012; JPH10262794 (Kai Takeko) "Disposable flower vase", publication date: 6 Oct. 1998; JPH03191909 (Honda Masaru) "Folding flower vase", publication date: 21 Aug. 1991; JP2009119214 (Morita Hisao) "Foldable and sectional flower vase", publication date: 4 Jun. 2009; JP2004188046 (Mori Takaharu) "Paper-made flower vase", publication date: 8 Jul. 2004; US2004/083,649 (Donald Weder) "Method of covering a potted plant using a floral sleeve having a hinged inner bottom member", publication date: 6 May 2004; U.S. Pat. No. 6,672,002 (Marie Gumpper) "Package for transporting and displaying bunches of fresh cut flowers", publication date: 6 Jan. 2004; WO2003/053, 197 (Gustav Stibranyl) "Turnover prevented vase", publication date: 3 Jul. 2003.

SUMMARY OF THE INVENTION

The present invention relates to a vase, amenable for one-time use, i.e. disposable.

In accordance with embodiments the present invention there is provided a vase including sidewalls; an open upper end; a vase bottom; and at least one water-receiving compartment. The water receiving compartment is substantially located proximal to the vase bottom; configured to hold water; and includes at least one flower support base including at least one aperture which is spaced apart from the vase bottom. The at least one aperture is configured to allow water to pass there-through and configured or disposed to prevent stems of the flowers to pass through. As a result, when in use, flowers in the vase are prevented from consuming the water in the compartment.

In some embodiments, the vase is configured to fold into a generally flat structure. In some embodiments the vase is configured to have a rectangular footprint. In some embodiments, the vase is configured to have any of the following shaped footprints: hexagonal; triangular; circular and octagonal.

In some embodiments, the flower support base is part of an insertable water container. In some embodiments, the insertable water container includes at least one aperture top pivotable about a water container edge. In some embodiments, the at least one aperture is a plurality of apertures. In some embodiments, at least one of the at least one apertures is disposed adjacent at least one of the side walls.

In some embodiments, the flower support base has a conical or frustoconical shape thereby allowing the flowers stems to reach the bottom of the vase. In some embodiments, there is at least one gap between the flower support base and the sidewalls, the at least one gap constituting at least a portion of the at least one aperture.

In some embodiments, the vase is formed in one piece; whereas in some embodiments the lower portion of the vase (which may consist of the bottom or the bottom and the water receiving compartment) is connectable to the remaining (upper) portion of the vase.

The term "flowers" and derivatives thereof, herein the specification ad claims, will be used to denote and type of flowers or combinations thereof or vegetation or the like that consumes or soaks up water.

The term "sidewalls" and derivatives thereof, herein the specification and claims, will be used in its broadest sense and include any number of walls contributing to or a part of the side of the vase, including the wall of a generally cylindrical, box like or conical vase.

The term "apertures" and derivatives thereof, refer herein the specification and claims to any mechanism for the passage of water, including one or more gaps that may be formed between the flower support base and vase's sidewalls.

It is a particular feature of the present vase that it is designed to be disposable and light-weight, yet when in use to be resistant to falling over.

BRIEF DESCRIPTION OF THE DRAWINGS

The invention may be more clearly understood upon reading of the following detailed description of non-limiting exemplary embodiments thereof, with reference to the following drawings, in which.

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS

Illustrative embodiments of the invention are described below. In the interest of clarity, not all features/components of an actual implementation are necessarily described.

In particular embodiments, the vase is intended to be used one time, or merely a few times. As such, the vase need not be cleaned. Thus, in particular embodiments, the vase is intended to be made of a low-cost and preferably light-weight material (and may thus also be referred to herein as a light-weight or disposable vase). Such material is preferably an environmental friendly material, for example a recyclable or biodegradable material. Exemplary materials include coated paperboard material such as used for milk cartons, plastic sheets or a foil, e.g. laminated foil.

Figure 1:
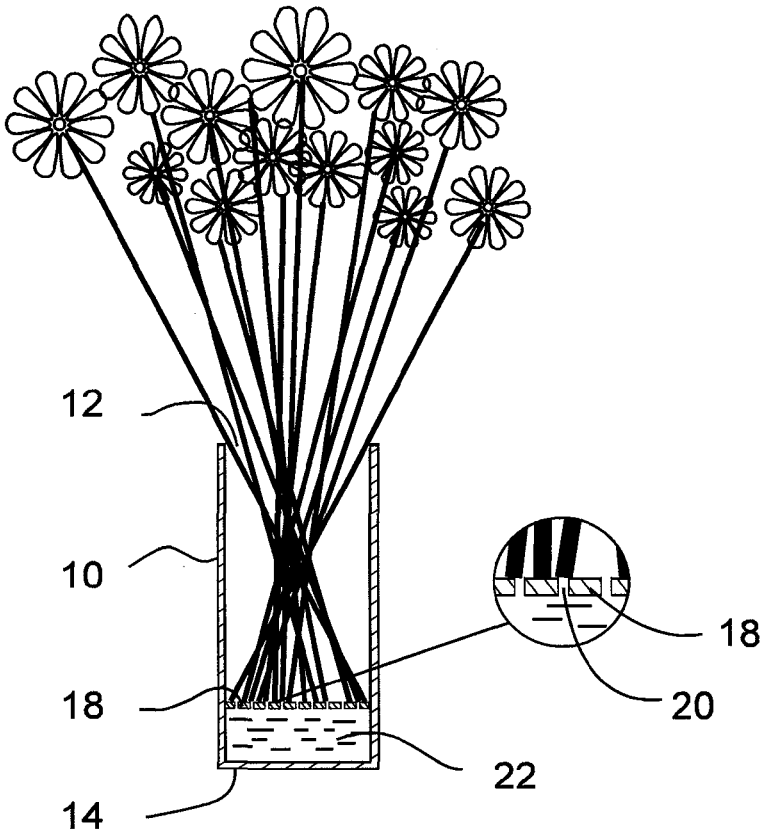
FIG. 1 is a side sectional view of an embodiment of a vase of the present invention in use, and an enlargement of a portion thereof.
Figure 2:
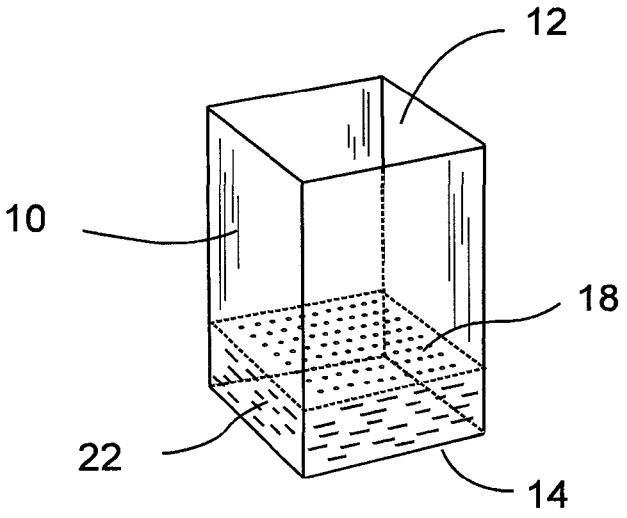
FIG. 2 is a perspective view of another embodiment of the present vase.

FIGS. 1 and 2 show an embodiment of a vase of the present invention. The vase includes a plurality of sidewalls 10, exemplified by four sidewalls whereby the upper edges of the sidewalls define an open upper end 12 of the vase. It should be understood that the sidewalls could be cylindrical, oval or other such form, for example flaring upward, curved and so on.

Figure 9:
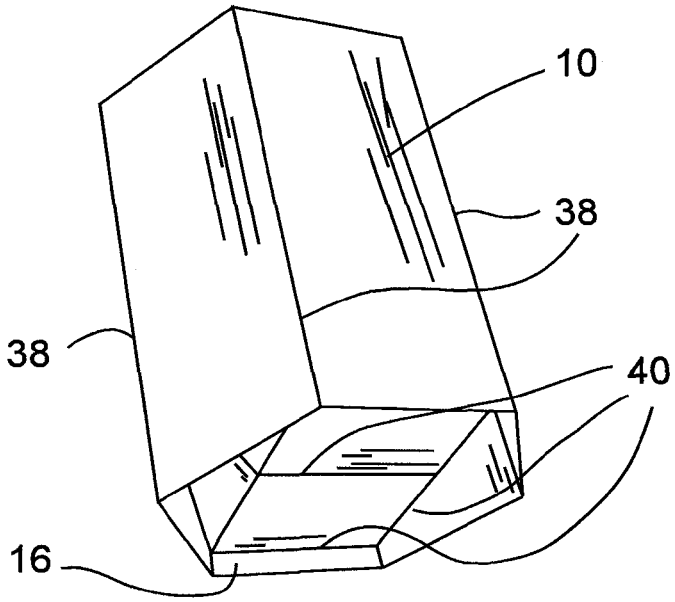
Figure 10:
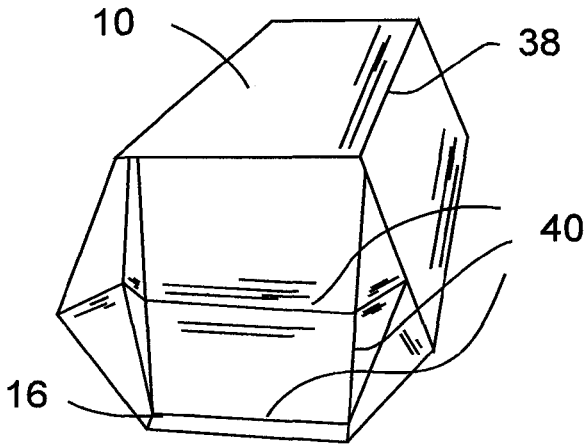

The light-weight vase also includes a vase bottom 14, which may be disposed relative to sidewalls 10 so as to rest directly on a surface (as shown) or to be somewhat spaced apart from a rest-surface, i.e. wherein lower edge portions 16 of the sidewalls 10 act like feet, to improve stability (FIG. 9).

Upwardly spaced apart from bottom 14, within the confines of sidewalls 10, is a false bottom or flower support base 18. Flower support base 18 has at least one water aperture 20, and typically a plurality of apertures, dimensioned so water can readily pass through the apertures.

In some embodiments, flower support base 18 may include a perforated false bottom. Apertures 20 are dimensioned and/or configured and/or disposed so that flower stems will not pass through. For example, apertures 20 may be smaller than the diameter of the stems of the flowers (as illustrated) and/or shaped and/or disposed in a manner or location where the stems are not likely to rest; for example the apertures may be angled and/or located in the corners of the false bottom 18, or a combination thereof (not shown). It should be understood that the term "apertures" and derivatives thereof, are intended herein the specification and claims to also include one or more gaps between flower support base 18 and sidewalls 10.

In the above-described embodiments, bottom 14, sidewalls 10 and flower support base 18 define a water receiving compartment 22.

In operation, water can be poured into the vase and that water will readily pass downward through apertures 20 and collect in compartment 22. The weight of the water in compartment 22 will provide stability to the vase. Water should be poured until the water level is above flower support base 18 so that the flowers will receive water.

Due to the design of the vase, in particular flower support base 18 with apertures 20, even if the flowers consume all the water available to them, i.e. the water above flower support base 18, compartment 22 will remain completely full thereby providing stability to the vase. If the vase did not have the weight of the water in compartment 22, and the flowers consumed all or a significant portion of the water, the empty (light-weight) vase could potentially fall over, due to the high center of gravity of the flowers therein.

Figure 3:
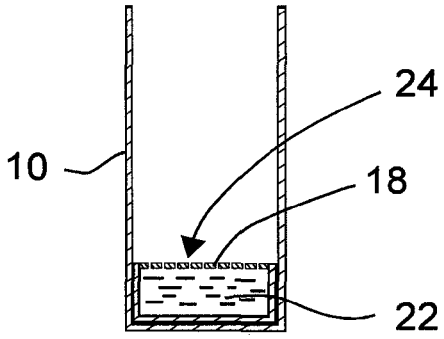
FIGS. 3 and 4 are side sectional views of another embodiment of the present vase.
Figure 4:
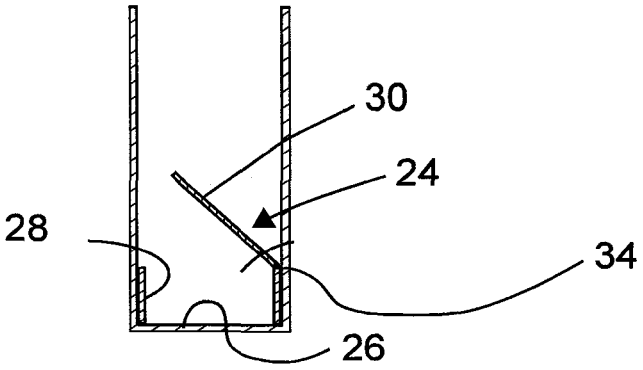

With reference to FIGS. 3 and 4, in another embodiment, compartment 22 can be a separate water container 24 (e.g. cardboard box-like structure) that can be filled separately and inserted by the user into the vase—or filled after the water container is placed inside the vase. It should also be understood that the vase can be designed so the vase is formed or sold with container 24 disposed therein. Water container 24 can have a bottom 26, sides 28 and apertured top 30. In some embodiments, apertured top 30 is pivotably connected to one of the container sides 28 at a water container pivot edge 34. Alternatively, apertured top 30 is connected to two opposite container sides 28, with a fold in the middle of the aperture top.

Figure 5:
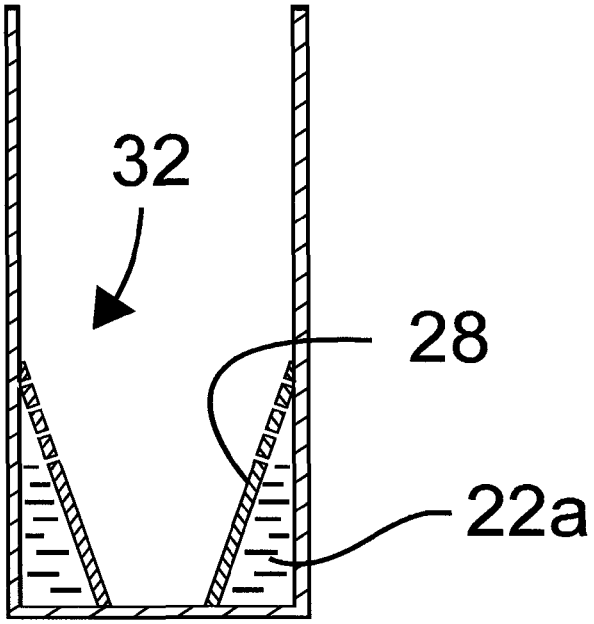
FIG. 5 is a side sectional view of another embodiment of the present vase.

FIG. 5 illustrates another compartment-like structure 32, formed by sides 28 although alternatively configured in a conically or frusto-conically shaped structure or the like. Structure 32 defines a water compartment 22*a* or pair thereof, as exemplified in FIG. 5. As above, structure 32 includes apertures 20, however only at the upper portion of sides 28. For illustration purposes, FIG. 5 shows the situation when water is filled (or remains) only up to the level where apertures 20 begin, which would be the situation in the vase after the flowers consumed all the water available to them. In practice, water would be filled above the level of apertures 20 so that water compartment 22*a* would fill with water, as well as the volume of the inner conical portion of compartment-like structure 32. It should be understood, in particular where the structure 32 includes a frusto-conically shaped portion, that flower-support base 18 may be partially constituted by vase bottom 14. However, in some embodiments, structure 32 may be spaced apart from bottom 14.

Figure 6:
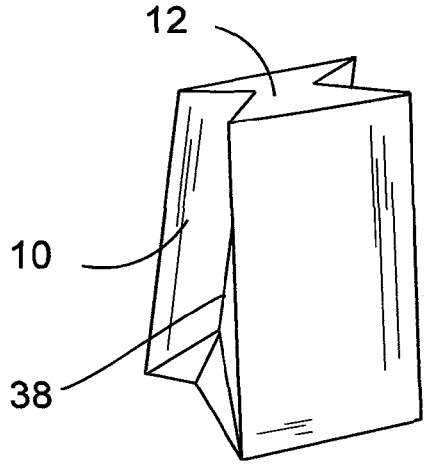
FIGS. 6 and 7 are different perspective views of a foldable embodiment of the present vase with an exemplary rectangular footprint.
Figure 7:
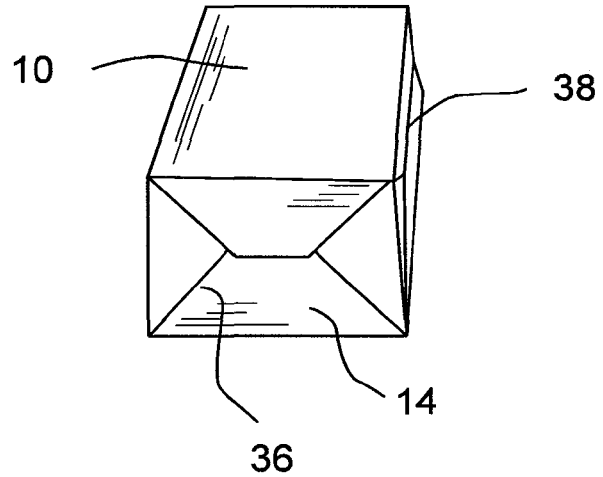
Figure 8:
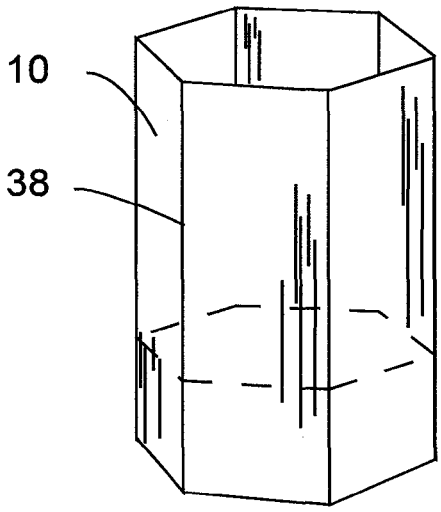
FIGS. 8-12 are various perspective views of another foldable embodiment of the present vase having an exemplary hexagonal footprint.

FIGS. 6 and 7 depict a foldable embodiment of the vase wherein bottom 14 has, for example, envelope-shaped fold lines 36 at bottom 14 so that the bottom can fold upward into the vase structure. In addition, side-wall fold lines 38 allow the complete collapse or folding to an essentially flat configuration for ease of storage, packaging and sales display. Although not visible in FIGS. 6 and 7, flower support base 18 is also foldable in a similar manner as bottom 14 in order to facilitate folding (and opening) of the vase.

Figure 11:
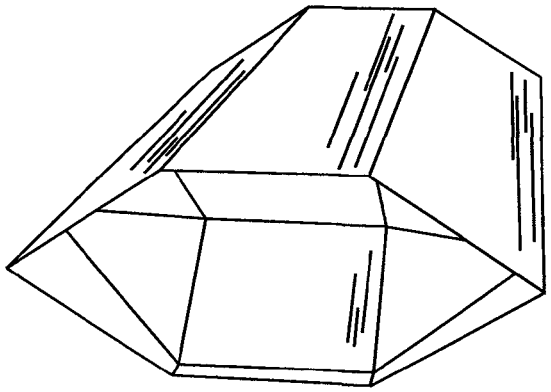
Figure 12:
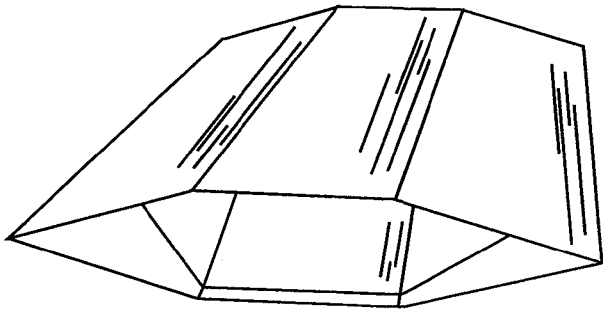

FIGS. 8-12 illustrate another exemplary foldable vase configuration wherein bottom 14 has a hexagonal footprint. Bottom 14 can be folded along fold lines 40 so that the bottom can be folded generally flat as noted above. Also illustrated particularly in FIG. 9, is an embodiment wherein the vase has lower edge portions 16 or wall extensions so that bottom 14 will be spaced apart from a surface upon which the vase rests. FIGS. 11 and 12 show the vase being flattened.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

The invention claimed is:

1. A vase for holding flowers having stems, the vase comprising:

sidewalls;

an open upper end;

a vase bottom; and at least one water-receiving compartment that is:

(i) substantially located proximal to the vase bottom;

(ii) configured to hold water; and (iii) comprises at least one flower support base, the at least one flower support base comprising at least one aperture, wherein, in combination:

(1) the vase is configured to fold into a generally flat structure; and (2) the at least one aperture:

(a) is spaced apart from the vase bottom;

(b) is configured to allow water to pass therethrough; and (c) is smaller than the diameter of individual stems of the flowers so as to prevent the individual stems of the flowers to pass through the at least one aperture of the at least one flower support base and to prevent the stems from contacting water in the at least one water-receiving compartment.

2. The vase of claim 1, wherein the vase is configured to have a rectangular footprint.

3. The vase of claim 1, wherein the vase is configured to have any one of the following shaped footprints: hexagonal; triangular; circular and octagonal.

4. The vase of claim 1, wherein the water-receiving compartment comprises an insertable water container, which includes the flower support base.

5. The vase of claim 4, wherein the insertable water container comprises at least one apertured top pivotable about a water container edge.

6. The vase of claim 1, wherein the flower support base has a conical or frustoconical shape.

7. The vase of claim 1, wherein the at least one aperture is a plurality of apertures.

8. The vase of claim 1, wherein at least one of the at least one aperture is disposed adjacent at least one of the side walls.

9. The vase of claim 1, wherein there is at least one gap between the flower support base and the sidewalls, the at least one gap constituting at least a portion of the at least one aperture.

10. The vase of claim 1, wherein the at least one aperture is angled in a manner to prevent the individual stems of the flowers to pass through the at least one aperture.

11. The vase of claim 1, wherein the at least one aperture is shaped in a manner to prevent the individual stems of the flowers to pass through the at least one aperture.

12. The vase of claim 1, wherein the at least one aperture is located in a corner of the flower support base.

* * * * *